US009675506B2

(12) United States Patent
Fisher, Sr.

(10) Patent No.: US 9,675,506 B2
(45) Date of Patent: Jun. 13, 2017

(54) PROTECTIVE SHIELD SYSTEMS FOR CONTROL INTERFACES OF MOBILITY DEVICES

(71) Applicant: Jan E. Fisher, Sr., Lyndora, PA (US)

(72) Inventor: Jan E. Fisher, Sr., Lyndora, PA (US)

( * ) Notice: Subject to any disclaimer, the term of this patent is extended or adjusted under 35 U.S.C. 154(b) by 0 days.

(21) Appl. No.: 15/066,074

(22) Filed: Mar. 10, 2016

(65) Prior Publication Data

US 2016/0272057 A1 Sep. 22, 2016

Related U.S. Application Data

(60) Provisional application No. 62/130,793, filed on Mar. 10, 2015.

(51) Int. Cl.
*A61G 5/10* (2006.01)

(52) U.S. Cl.
CPC ..... *A61G 5/10* (2013.01); *A61G 2203/14* (2013.01)

(58) Field of Classification Search
CPC A61G 5/10; A61G 5/04–5/048; A45C 11/329
USPC ..... 150/154; 383/61.4, 74, 75, 76, 103; 206/320
See application file for complete search history.

(56) References Cited

U.S. PATENT DOCUMENTS 4,420,078 A * 12/1983 Belt ..... A61N 1/37 206/305
5,499,713 A * 3/1996 Huffer ..... H01H 9/0242 206/320
5,718,104 A * 2/1998 Kennedy ..... H04B 1/3888 150/154
5,873,456 A * 2/1999 Hull ..... H01H 9/0242 206/305
6,082,535 A * 7/2000 Mitchell ..... A45C 11/00 150/154
6,612,432 B2 * 9/2003 Motson ..... A45F 5/00 206/305
6,701,159 B1 * 3/2004 Powell ..... A45C 11/00 379/446
6,772,881 B2 * 8/2004 Le ..... H01H 9/0242 150/165
6,948,614 B1 * 9/2005 Hall ..... A45C 11/329 150/154

(Continued)

*Primary Examiner* — David Purol
(74) *Attorney, Agent, or Firm* — Bartony & Associates, LLC

(57) ABSTRACT

A protective shield system protects a control interface of a wheelchair from environmental factors. The control interface includes a handle extending from a housing of the control interface to control motion of the wheelchair and one or more actuating mechanisms on the housing of the control interface to control one or more wheelchair functions. The protective shield system includes a flexible cover including at least one opening therein. The opening encompasses the handle when the cover is placed in operative connection with the control interface. The flexible cover further includes a releasable closure mechanism via which the at least one opening may be closed around a base of the handle. At least a portion of the flexible cover which is placed over the one or more actuating mechanisms is translucent. The one or more actuating mechanisms are actuatable by a user of the wheelchair by contact by the user with an outer surface of the portion of the flexible cover which is placed over the one or more actuating mechanisms.

16 Claims, 6 Drawing Sheets

(56) References Cited

U.S. PATENT DOCUMENTS

| | | | | |
|---|---|---|---|---|
| 2004/0140028 | A1* | 7/2004 | Clark | A61B 46/10 150/154 |
| 2005/0279661 | A1* | 12/2005 | Hodges | H01H 9/0242 206/320 |
| 2008/0142129 | A1* | 6/2008 | Reasner | A45C 11/32 150/131 |
| 2008/0295932 | A1* | 12/2008 | Havens | G06K 7/10881 150/154 |

* cited by examiner

PROTECTIVE SHIELD SYSTEMS FOR CONTROL INTERFACES OF MOBILITY DEVICES

CROSS-REFERENCE TO RELATED APPLICATIONS

This application claims benefit of U.S. Provisional Patent Application Ser. No. 62/130,793, filed Mar. 10, 2015, the disclosure of which is incorporated herein by reference.

BACKGROUND

The following information is provided to assist the reader in understanding technologies disclosed below and the environment in which such technologies may typically be used. The terms used herein are not intended to be limited to any particular narrow interpretation unless clearly stated otherwise in this document. References set forth herein may facilitate understanding of the technologies or the background thereof. The disclosure of all references cited herein are incorporated by reference.

Many people of limited mobility rely on mobility devices for transportation. The term "mobility device" refers to devices for providing mobility to individuals of restricted mobility, including, but not limited to, wheelchairs, scooters, track systems and the like. Such wheeled mobility devices are sometimes referred to herein collectively as wheelchairs. Mobility devices are often powered via, for example, a battery-powered electric motor and are often referred to as powered mobility devices. A control system in operative connection with the battery-powered electric motor and the drive train of the mobility device includes a control module or control interface including one or more controls (for example, a joy stick and one or more actuatable buttons or switches) within the reach of and operable by the user of the mobility device.

Mobility devices must be used by persons of restricted mobility regardless of the environmental conditions. Water (for example, from, rain, snow, mist etc.) and/or other contaminants may, for example, come into contact with the controls of the control interface of a powered mobility device and cause malfunction thereof. The user may lose use of the powered mobility device for an extended period of time and repair thereof may be very expensive. It is thus desirable to develop a protective device or system to protect the control interface of a powered mobility device from environmental conditions.

SUMMARY

In one aspect, a protective shield system protects a control interface of a wheelchair from environmental factors. The control interface includes a handle extending from a housing of the control interface to control motion of the wheelchair and one or more actuating mechanisms on the housing of the control interface to control one or more wheelchair functions. The protective shield system includes a flexible cover including at least one opening therein. The opening encompasses the handle when the cover is placed in operative connection with the control interface. The flexible cover further includes a releasable closure mechanism via which the at least one opening may be closed around a base of the handle. At least a portion of the flexible cover which is placed over the one or more actuating mechanisms is translucent. The one or more actuating mechanisms are actuatable by a user of the wheelchair by contact by the user with an outer surface of the portion of the flexible cover which is placed over the one or more actuating mechanisms (via force transmitted through that portion of the flexible cover overlaying the actuating mechanism).

In a number of embodiments, the protective shield system further includes a releasable lower closure mechanism via which the cover can be secured around a bottom section of the control interface. The at least one opening may, for example, extend around a rear of the cover to a lower section of the cover and the releasable lower closure mechanism may, for example, include a drawstring extending through a passage formed around a portion of the opening. The cover may, for example, further releasable a releasable rear closure mechanism via which the cover can be secured around a rear section of the control interface In a number of embodiments, the cover includes at least one vent passage formed therethrough.

In a number of embodiments, the flexible cover includes an upper section including the at least a portion of the flexible cover which is placed over the one or more actuating mechanisms, and which is translucent and a side section attached to at least a portion of a perimeter of the upper section. The side section may, for example, be openable at a rearward portion thereof. The flexible cover may, for example, further include a releasable rear closure mechanism via which extending sections at the rearward portion of the side section can be secured around a rear portion of the control interface.

The flexible cover may further include a releasable lower closure or securing mechanism extending around at least a portion of a lower perimeter of the side section via which the flexible cover can be secured around a bottom section of the control interface. The releasable lower closure mechanism may, for example, include a drawstring extending through a passage formed around the at least the portion of the lower perimeter of the side section.

The protective shield system may further include an extending section of elastic material attached at one end to a first side of the cover and attached at another end thereof to a second side of the cover. The extending section of elastic material is adapted to extend under the control interface when the cover is placed in operative connection with the control interface. In a number of embodiments, the extending section of elastic material is attached at one end to a perimeter of the upper section at a first side of the upper section and is attached at another end thereof to the perimeter of the upper section at a second side of the upper section.

In another aspect, a method of protecting a control interface of a wheelchair, wherein the control interface includes a handle extending from a housing of the control interface to control motion of the wheelchair and one or more actuating mechanisms on the housing of the control interface to control one or more wheelchair functions, includes placing a protective shield system over at least a portion of the housing of the control interface, the protective shield system including a flexible cover having at least one opening therein, so that the opening encompasses the handle, and closing a releasable closure mechanism in operative connection with the opening to close the opening around a base of the handle. At least a portion of the cover which is placed over the one or more actuating mechanisms is translucent. The one or more actuating mechanisms is actuatable by a user of the wheelchair by contact by the user with an outer surface of the portion of the flexible cover which is placed over the one or more actuating mechanisms.

In a number of embodiments, the cover further includes a releasable lower closure mechanism, and the method further includes securing the cover around a bottom section of the control interface via the releasable lower closure mechanism. Securing the cover around the bottom section of the control interface may, for example, include tightening a drawstring of the releasable lower closure mechanism. In a number of embodiments, the method further includes closing a releasable rear closure mechanism of the cover to secure the cover around a rear section of the control interface.

The present devices, systems, and methods, along with the attributes and attendant advantages thereof, will best be appreciated and understood in view of the following detailed description taken in conjunction with the accompanying drawings.

DETAILED DESCRIPTION

It will be readily understood that the components of the embodiments, as generally described and illustrated in the figures herein, may be arranged and designed in a wide variety of different configurations in addition to the described representative embodiments. Thus, the following more detailed description of the representative embodiments, as illustrated in the figures, is not intended to limit the scope of the embodiments, as claimed, but is merely illustrative of representative embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

As used herein and in the appended claims, the singular forms "a," "an", and "the" include plural references unless the context clearly dictates otherwise. Thus, for example, reference to "closure mechanism" includes a plurality of such closure mechanisms and equivalents thereof known to those skilled in the art, and so forth, and reference to "the closure mechanism" is a reference to one or more such closure mechanisms and equivalents thereof known to those skilled in the art, and so forth. Recitation of ranges of values herein are merely intended to serve as a shorthand method of referring individually to each separate value falling within the range. Unless otherwise indicated herein, and each separate value, as well as intermediate ranges, are incorporated into the specification as if individually recited herein. All methods described herein can be performed in any suitable order unless otherwise indicated herein or otherwise clearly contraindicated by the text.

Figure 1:
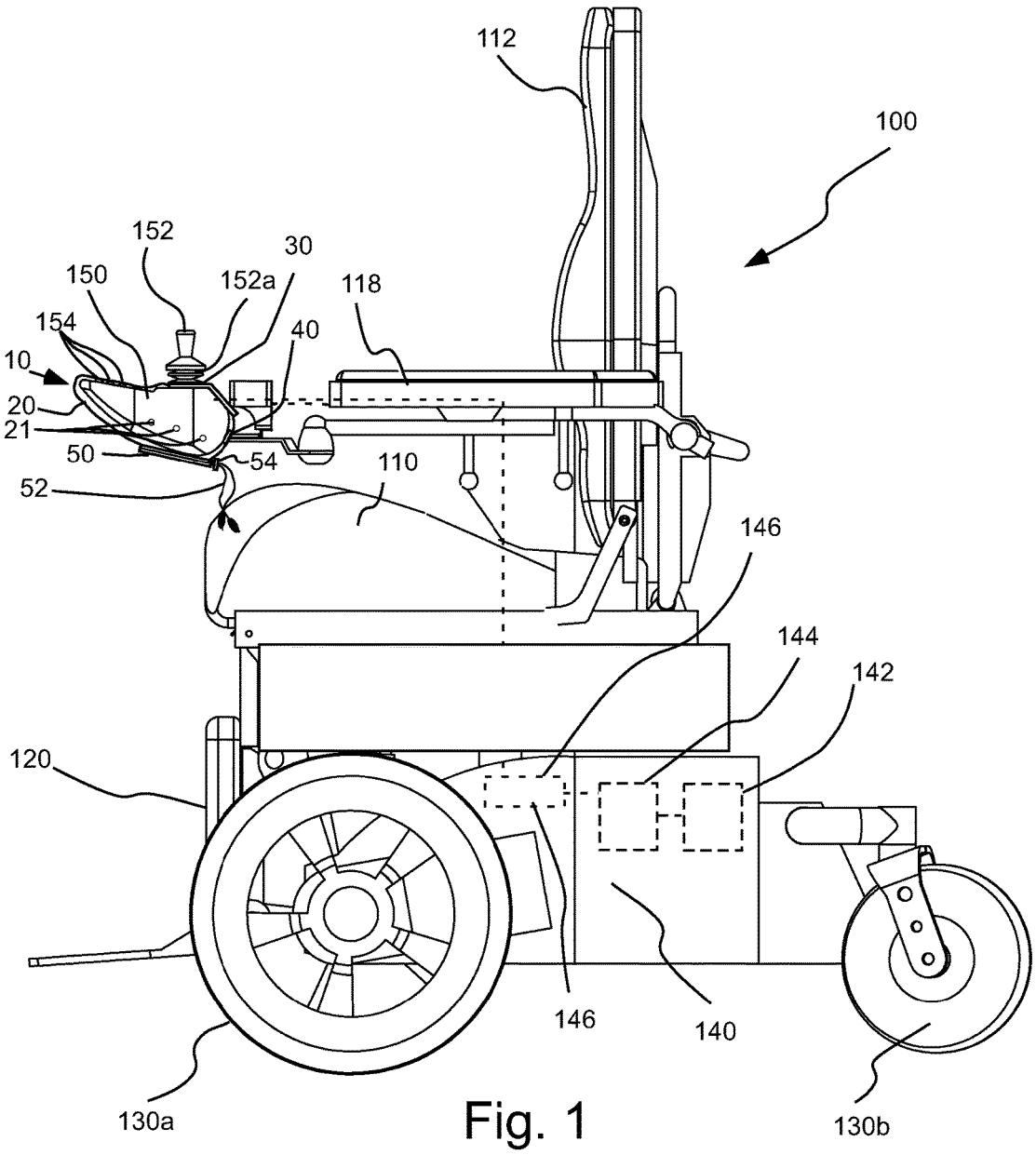
FIG. 1 illustrates schematically a powered mobility device in the form of powered wheelchair with a protective shield system or protective cover system hereof in operative connection with a control interface of the powered wheelchair.

FIG. 1 illustrates an embodiment of a powered mobility device in the form of a wheelchair 100 which includes a seat 110, a seat backrest 112 and left and right armrests 118 (only, the left armrest is shown in the side view of FIG. 1). Powered wheelchair 100 further includes a leg rest 120. Front wheels 130*a* and rear wheels 130*b* (which may, for example, be castors) provide mobility and a driven by a drive train 140 which, as known in the powered wheelchair arts, may include a rechargeable battery system 142 and one or more electric motors 144 in operative connection with rechargeable battery system 142. A control system 146 (for example, including one or more processors or microprocessors and associated memory systems) is operatively connected to motor 144.

Powered wheelchair 100 further includes a controller, control module or control interface 150 in operative connection with left armrest 118. In the illustrated embodiment, control interface 150 includes a joystick 152 extending therefrom. In some embodiments of mobility devices, joystick 152 may be replaced with other handles, such as a ball, T-handle, or goal-post. Joystick 152 may, for example, be connected to control system 146 via wiring. As used herein, the term "joystick" or "handle" refers collectively to any such handle or interface extending from a housing of a control interface via which the user of a powered wheelchair controls motion of the wheelchair. Deflection of joystick 152 results in a signal to control system 146, which is translated into current and voltage energy to send to one or more motors 144, which draw energy from battery system 142. In a number of embodiments, if joystick 152 is deflected forward, control system may, for example, signal to provide the same amount of energy to two motors 144 to move powered wheelchair 100 in a straight line forwards. If joystick is deflected to the left to turn powered wheelchair 100 in a leftward direction, more energy is directed to a right motor 144 to allow the right side of powered wheelchair 144 to move towards the left. Control interface 150 may include other control elements or actuating mechanisms 154 such as buttons or micro-switches on an upper section of a housing thereof which may, for example, provide for further control of wheelchair motion and/or control various aspects powered wheelchair 100 such as, for example, powered seating functions to, for example, control the positions and/or angle of one or more of seat 110, backrest 112, and leg rest 120.

As described above, water (for example, from, rain, snow, mist etc.) and/or other contaminants may, for example, come into contact with components of control interface 150 and cause malfunction thereof. In a number of embodiments hereof, a protective shield device or system 10 is provided which forms a barrier to such contamination. As illustrated in FIG. 1, protective cover or shield system 10 may include a flexible cover 20 formed from one or more sections of flexible sheet, film or membrane material that encompasses at least an upper portion of control interface 150. Cover 20 may, for example, be formed from one or more sections of flexible polymeric materials as known in the polymer arts. In the area of actuating mechanisms 154 of control interface 150, an upper section 20*a* of cover 20 is preferably a translucent or transparent flexible polymeric material (for example, a clear vinyl polymer or a polyethylene) so that a user of powered wheelchair 100 can view buttons, switches or other actuating mechanisms 150 and operate actuating mechanisms 150 through upper section 20*a*. In a number embodiments, upper section 20*a* of cover 20 was formed from a 20-gauge (approximately 0.19 inches or 0.47 mm in thickness), clear vinyl polymer. In a number of embodiments, a lower or side section 20*b* of cover 20 was formed from an opaque polymeric material. Section 20*b* may, for example, be formed from a more durable or tougher polymeric material than upper section 20*a* to withstand repeated tightening and loosening of a drawstring 52*a* used in placing cover 20 in operative connection with control interface 150 and removing cover 20 from operative connection with control interface 150 as described further below. In a number of embodiments, side section 20 was fabricated from a ripstop fabric. In general, a riptstop fabric is a woven fabric, made of from, for example, nylon, using reinforcing techniques that make the fabric resistant to tearing and ripping. In other embodiments, both of upper section 20*a* and side section 20*b* may be formed from the same material. Upper section 20*a* and side section 20*a* may, for example, be formed as separate sections which are attached or may be formed from a single, monolithic section of material.

In a number of embodiments, vent holes or passages 21 may be formed in cover 20 (for example, in side section 20*b*) to assist in preventing condensation of water on the inner side or protective shield system 10. However, in a number of embodiment, the bottom of cover 20 remains open, facilitating air movement.

Figure 2A:
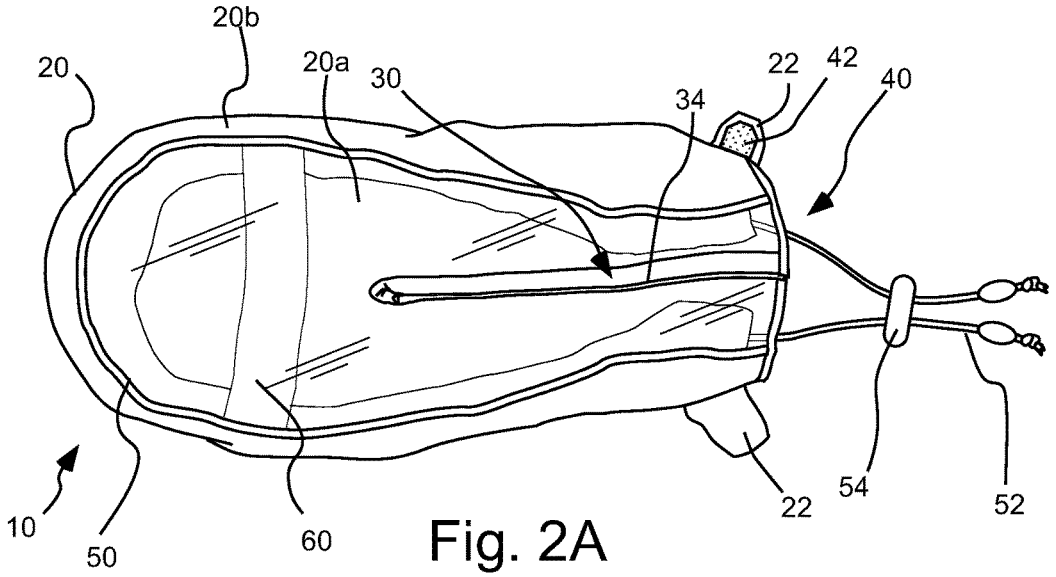
FIG. 2A illustrates a top perspective view of an embodiment of a protective shield system hereof when the protective shield system is not in operative connection powered mobility device, wherein the opening for the handle/joystick of the control interface is in a closed state.
Figure 2B:
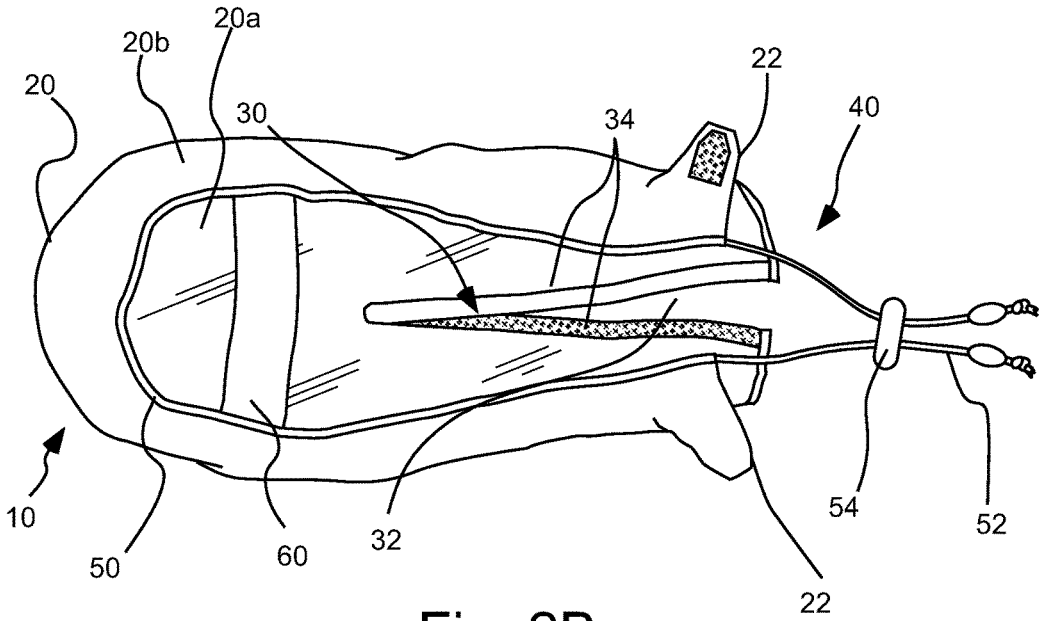
FIG. 2B illustrates a top perspective view of the protective shield system of FIG. 2A wherein the opening for the handle/joystick is in an open state.
Figure 2C:
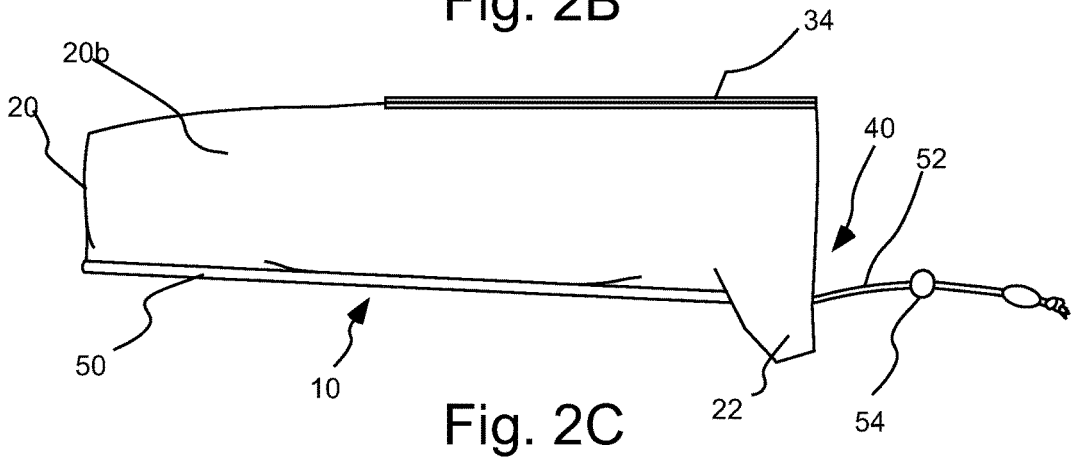
FIG. 2C illustrates a side perspective view of the protective shield system of FIG. 2A.

In the illustrated embodiment, one or more openings are provided in cover 20 so that protective shield system 10 can be placed over control interface 150. In the illustrated embodiment, the bottom of cover 20 is open and is defined generally by a lower perimeter of side section 20*b*. Upper section 20*a* of cover 20, which covers actuating mechanisms 154, includes a closable opening therein through which joystick 152 extends for user access when cover 20 is place in operative connection with control interface 150. In the illustrated embodiment, a closure mechanism 30 is provided in connection with the opening through which joystick 152 protrudes. In a number of embodiments, handle or joystick closure mechanism 30 seats around or under a rubber seal 152*a* that encompasses at least a lower portion of joystick 152. In a number of embodiments, cooperating hook-and-loop type (for example, VELCRO®) closure elements 34 are placed on the perimeter of a longitudinally extending opening or opening portion 32 (see, for example, FIG. 2B) which extends around the base of joystick 152 so that opening or opening portion 32 can be closed in substantially sealing engagement around the base of joystick 152.

In use of cover 20, opening 32 is placed in an open state by disconnecting closure elements 34 (and closure elements 42, which are further discussed below). Cover 20 is then placed over control interface 150. Cover 20 is then slid rearward over control interface 150. Upper section 20*a* (in the region of closure elements 34) is positioned under and around rubber seal 152*a* of joy stick 152. Cover 20 may be gently slid rearward until a forward end of opening 32 contacts joy stick 152. Closure element 34 are then connected to close opening 32 around joystick 152.

A rear closure mechanism 40 (see, for example, FIGS. 3E and 3F) may also be provided on a reward end of protective shield system 10 to enclose cover 20 of protective shield system 10 around a rearward portion of control interface 150. In a number of embodiments, side section 20*b* is generally U shaped and is open in a rearward portion thereof. Rear closure mechanism 40 may, for example, include cooperating hook-and-loop type closure elements 42 which are placed on extending sections or wings 22 of side section 20*b* of cover 20. Extending sections 22 may, for example, extend from each side of a rearward portion of side section 20*b* so that they may be closed around the rearward portion of control interface 150 (and, for example, around a rearward portion of upper section 20*a* and closure mechanism 30 thereof, in the illustrated embodiment) and be connected to assist in maintaining cover 20 in operative connection with control interface 150. Extending sections 22 and rear closure mechanism 40 also cover and protect at least a portion of closure mechanism 30. In that regard, a rearward portion of upper section 20 curves around and over a rearward surface of control interface 150 as illustrated in FIG. 3F. Rear closure mechanism 40 covers at least a section of this rearward portion of upper section 20*a* upon closure thereof as illustrated in FIG. 3G.

In the embodiment illustrated in FIGS. 1 through 3G, opening 32, when closure elements 34 and 42 are disengaged, continues from top section 20*a* of film 20 to a bottom portion thereof. In a number of embodiments, a lower closure mechanism 50 such as a drawstring mechanism is formed around at least a portion of a bottom of side section 20*b* of cover 20 so that protective cover system 10 can be tightened around the underside of control interface 150. As, for example, illustrated in FIGS. 2A through 2C, closure mechanism 50 may include a generally U-shaped passage formed in a lower or bottom section of film 20 (via, for example, sewing a portion of film 20 back over onto itself via stitching. A drawstring 52 is drawn through the passage and can be used to tighten film 20 around the bottom of control interface 150. A releasable locking mechanism 54 (for example, a spring-loaded rope buckle as known in the drawstring closure arts) may be slidably positioned on one or both ends of drawstring 52 to lock drawstring 52 in a tightened position.

Figure 3A:
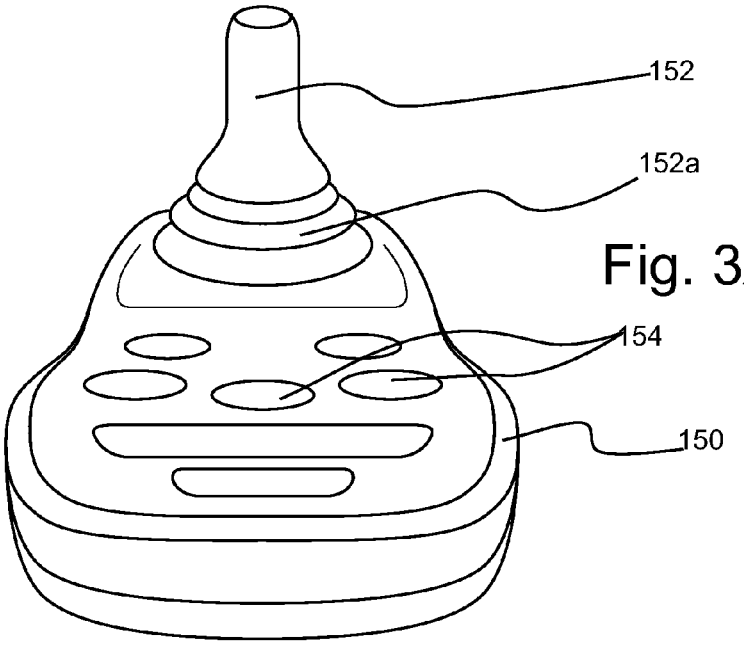
FIG. 3A illustrates an enlarged front perspective view of the control interface of the powered wheelchair of FIG. 1A.
Figure 3B:
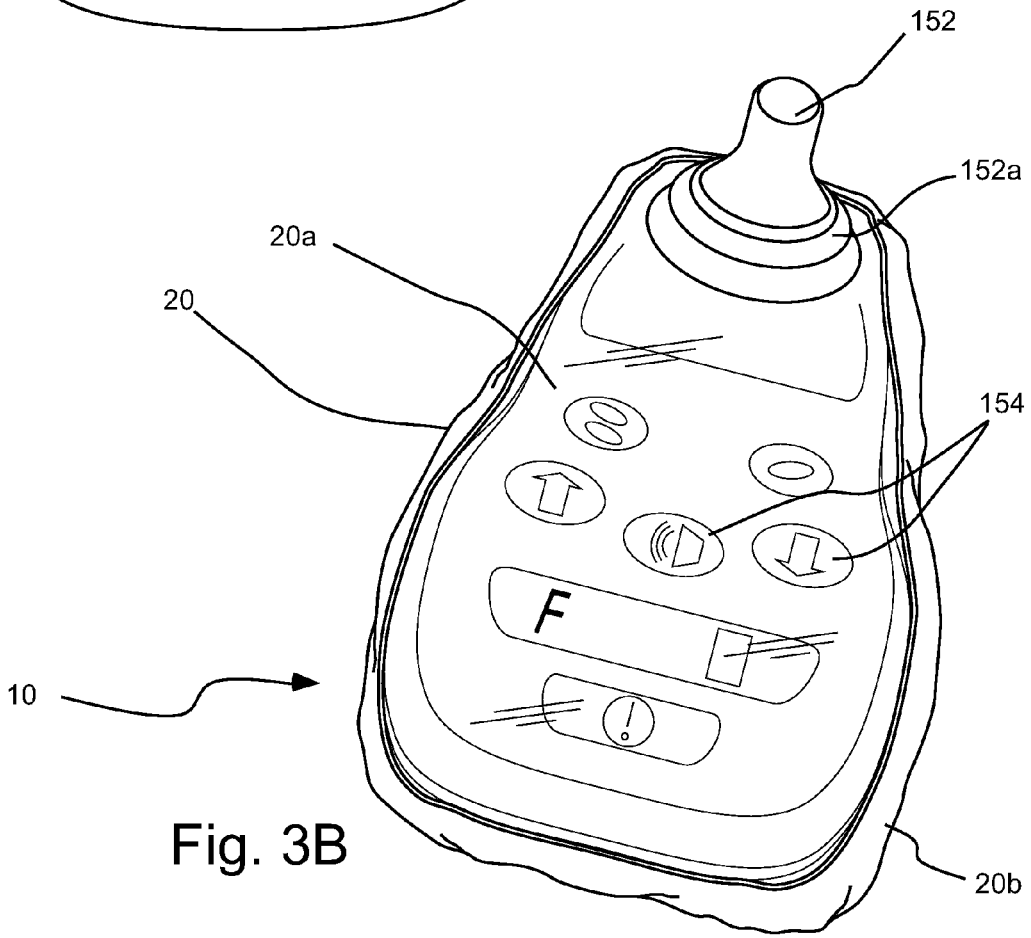
FIG. 3B illustrates a top perspective view of the control interface with the protective shield system hereof in operative connection therewith.
Figure 3C:
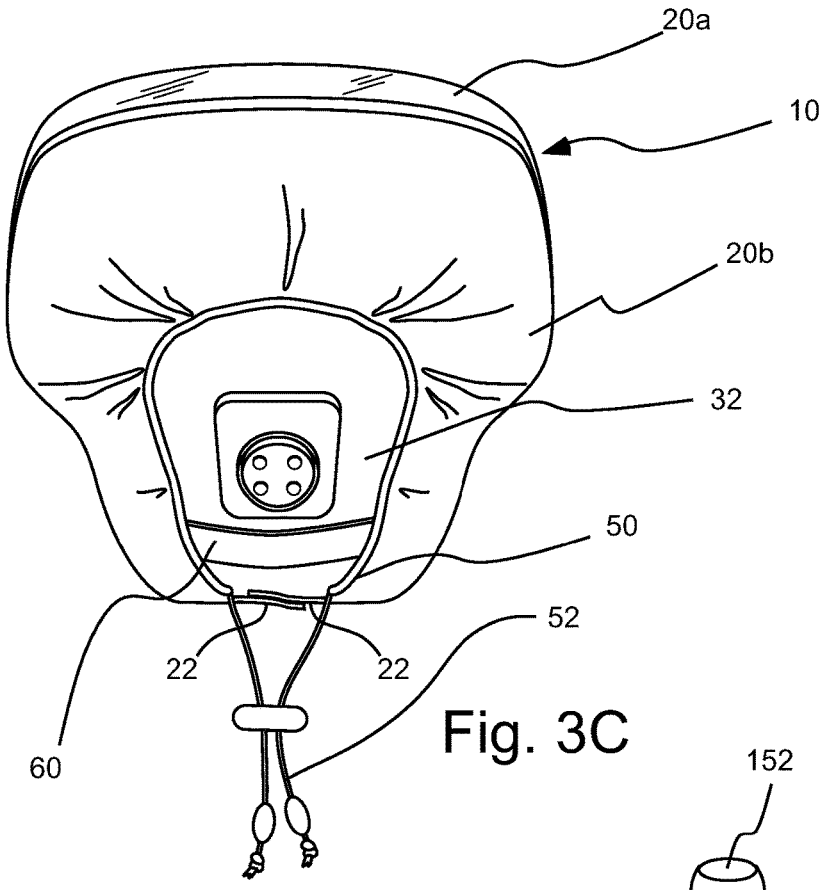
FIG. 3C illustrates a bottom perspective view of the control interface with a protective shield system hereof in operative connection therewith.
Figure 3D:
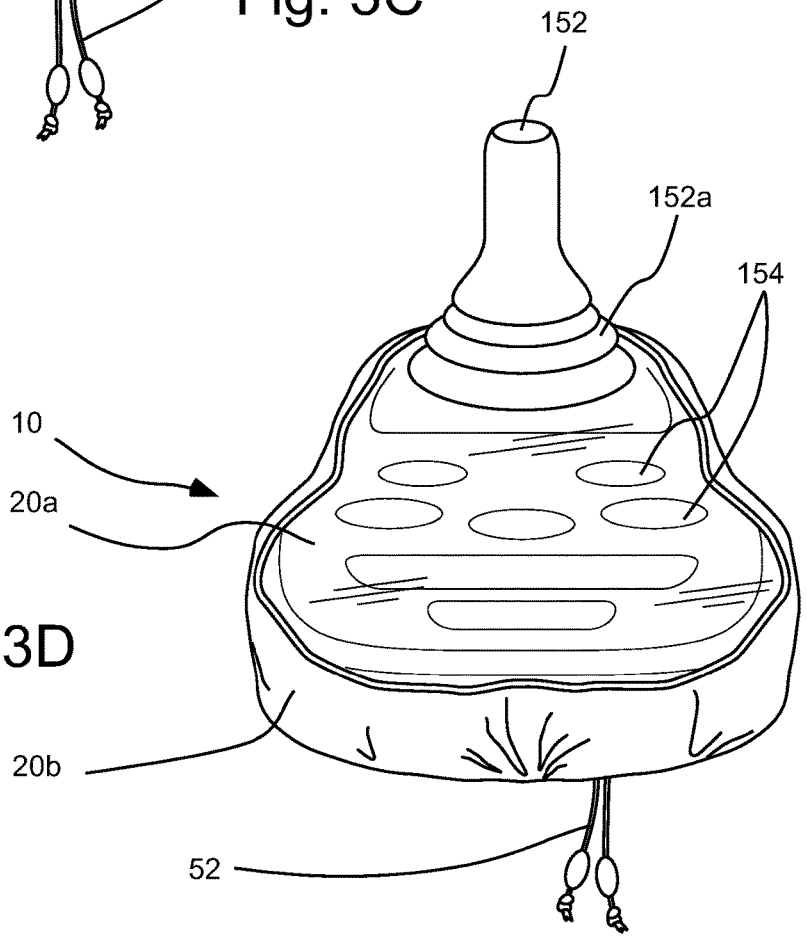
FIG. 3D illustrates a front perspective view of the control interface with a protective shield system hereof in operative connection therewith.
Figure 3E:
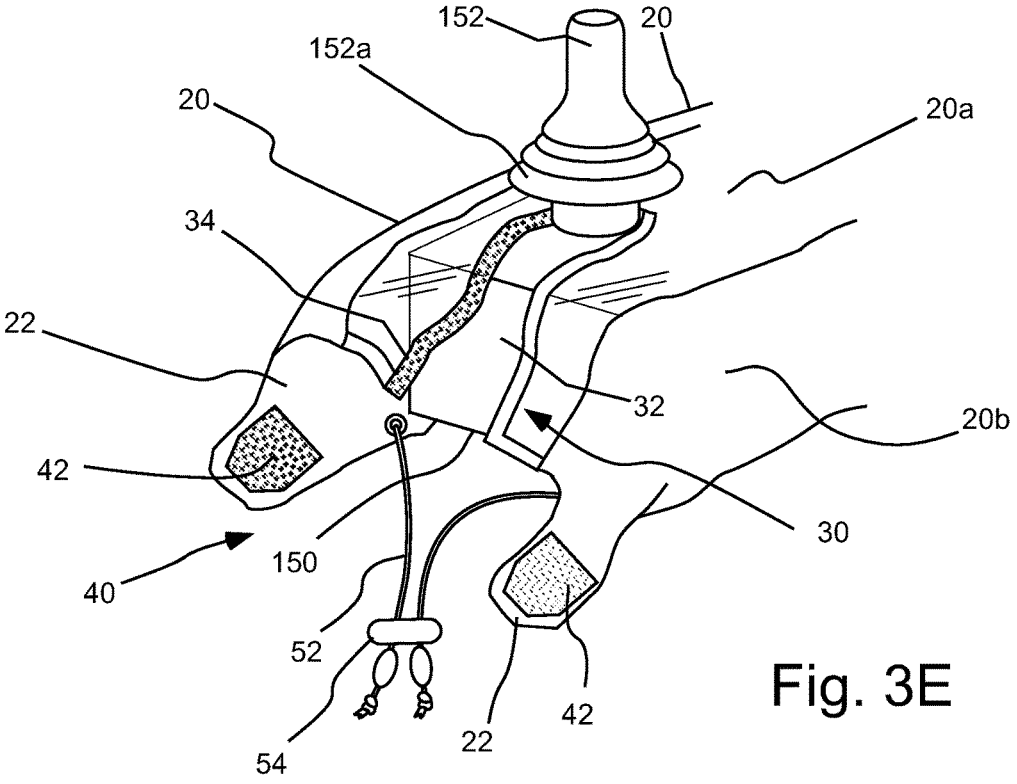
FIG. 3E illustrates a rear perspective view of the control interface wherein the opening for the control interface handle/joystick is in an open state and the rear closure mechanism of the cover is in an open state.
Figure 3F:
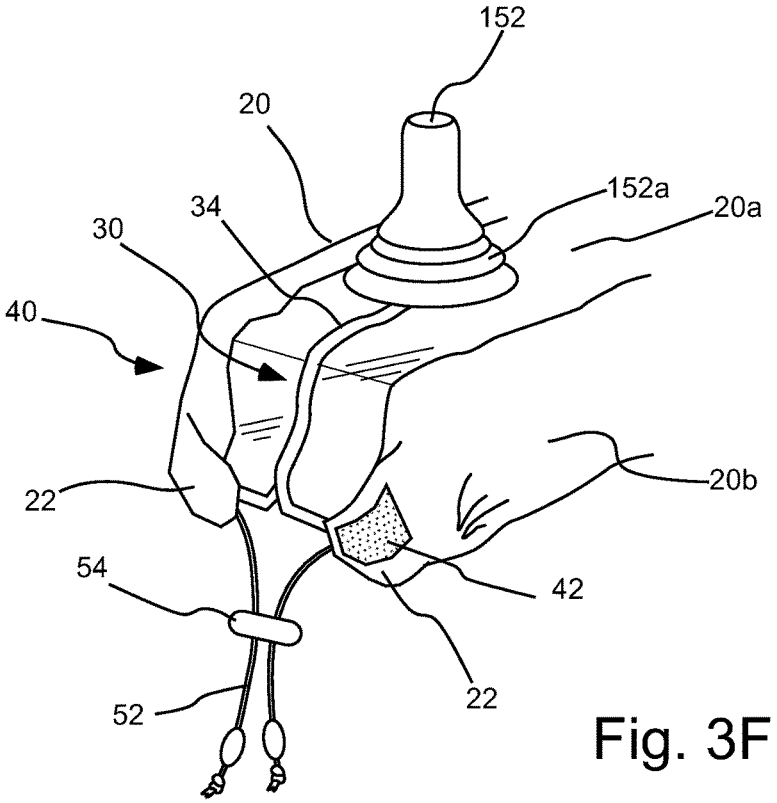
FIG. 3F illustrates a rear perspective view of the control interface wherein the opening for the control interface handle/joystick is in a closed state and the rear closure mechanism of the cover is in an open state.
Figure 3G:
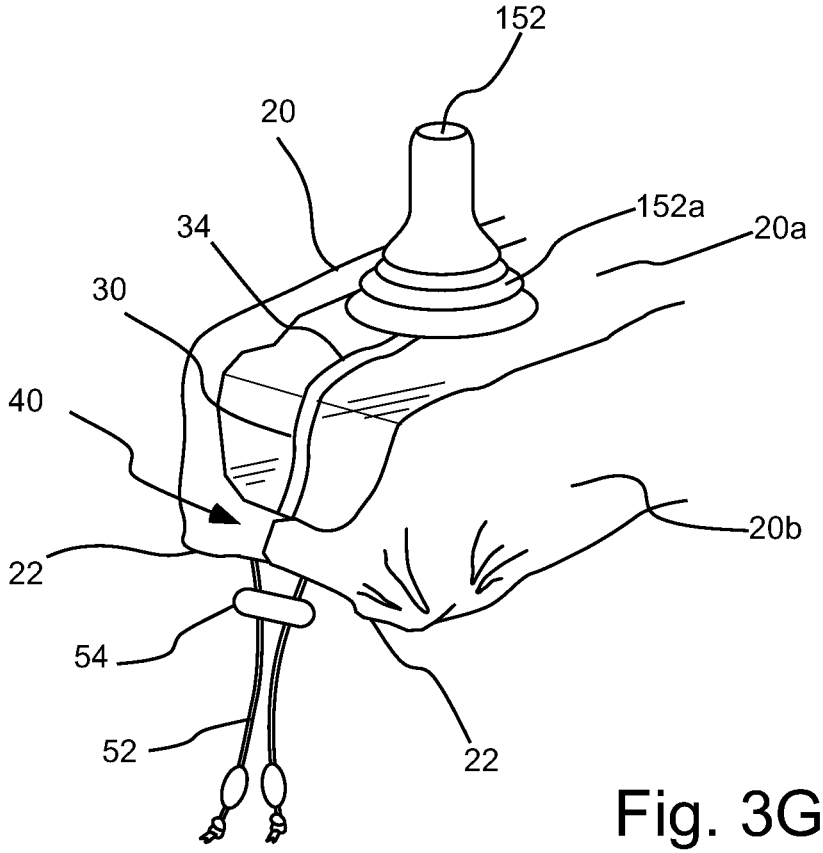
FIG. 3G illustrates a rear perspective view of the control interface wherein the opening for the control interface handle/joystick is in a closed state and the rear closure mechanism of the cover is in a closed state.

As illustrated in FIG. 3C, protective shield system 10 may further include a cross-member 60 which extends between opposing sides of cover 20 to assist in retaining cover 20 in operative connection with control interface 150. Cross member 60 may be attached, for example, to each side of side section 20*b* at a lower region thereof. In a number of embodiments, cross member 260 was attached to the lateral edges of upper section 20*a*, which assists in keeping upper section 20*a* in close cooperation with the upper surface of control interface 150. Cross-member 60 may, for example, be formed from an integral length of elastomeric material or may be formed from attachable length of material which may, for example, include cooperating hook-and-loop type closure elements.

Each protective shield system hereof can be made to fit a number of different types of control interfaces/control interface housings. One or more different protective shield systems hereof may be provided to extend coverage to widely varying control interfaces/control interface housings.

The foregoing description and accompanying drawings set forth a number of representative embodiments at the present time. Various modifications, additions and alternative designs will, of course, become apparent to those skilled in the art in light of the foregoing teachings without departing from the scope hereof, which is indicated by the following claims rather than by the foregoing description. All changes and variations that fall within the meaning and range of equivalency of the claims are to be embraced within their scope.

What is claimed is:

1. A protective shield system for a control interface of a wheelchair, the control interface including a handle extending from a housing of the control interface to control motion of the wheelchair and one or more actuating mechanisms on the housing of the control interface to control one or more wheelchair functions, comprising:

a flexible cover comprising at least one opening therein, the opening encompassing the handle when the cover is placed in operative connection with the control interface, and a releasable closure mechanism via which the at least one opening may be closed around a base of the handle, wherein at least a portion of the flexible cover which is placed over the one or more actuating mechanisms is translucent, the one or more actuating mechanisms being actuatable by a user of the wheelchair by contact by the user with an outer surface of the portion of the flexible cover which is placed over the one or more actuating mechanisms.

2. The protective shield system of claim 1 further comprising a releasable lower closure mechanism via which the flexible cover can be secured around a bottom section of the control interface.

3. The protective shield system of claim 2, wherein the at least one opening extends around a rear of the flexible cover to a lower section of the cover and the releasable lower closure mechanism comprises a drawstring extending through a passage formed around a portion of the at least one opening.

4. The protective shield system of claim 2 wherein the flexible cover further comprises a releasable rear closure mechanism via which the flexible cover can be secured around a rear section of the control interface.

5. The protective shield system of claim 1 wherein the flexible cover comprises at least one vent passage formed therethrough.

6. The protective shield system of claim 1 wherein the flexible cover comprises an upper section comprising the at least a portion of the flexible cover which is placed over the one or more actuating mechanisms, and which is translucent, and a side section attached to at least a portion of a perimeter of the upper section.

7. The protective shield system of claim 6 wherein the side section is openable at a rearward portion thereof.

8. The protective shield system of claim 7 wherein the flexible cover further comprises a releasable rear closure mechanism via which extending sections at the rearward portion of the side section can be secured around a rear portion of the control interface.

9. The protective shield system of claim 7 wherein the cover further comprises a releasable lower closure mechanism extending around at least a portion of a lower perimeter of the side section via which the flexible cover can be secured around a bottom section of the control interface.

10. The protective shield system of claim 9 wherein the releasable lower closure mechanism comprises a drawstring extending through a passage formed around the at least the portion of the lower perimeter of the side section.

11. The protective shield system of claim 1 further comprising an extending section of elastic material attached at one end to a first side of the flexible cover and attached at another end thereof to a second side of the flexible cover, the extending section of elastic material being adapted to extend under the control interface when the flexible cover is placed in operative connection with the control interface.

12. The protective shield system of claim 6 further comprising an extending section of elastic material attached at one end to a perimeter of the upper section at a first side of the upper section and attached at another end thereof to the perimeter of the upper section at a second side of the upper section, the extending section of elastic material being adapted to extend under the control interface when the flexible cover is placed in operative connection with the control interface.

13. A method of protecting a control interface of a wheelchair, the control interface including a handle extending from a housing of the control interface to control motion of the wheelchair and one or more actuating mechanisms on the housing of the control interface to control one or more wheelchair functions, comprising:

placing a protective shield system over at least a portion of the housing of the control interface, the protective shield system comprising a flexible cover comprising at least one opening therein, so that the opening encompasses the handle, and closing a releasable closure mechanism in operative connection with the at least one opening to close the at least one opening around a base of the handle, wherein at least a portion of the flexible cover which is placed over the one or more actuating mechanisms is translucent, the one or more actuating mechanisms being actuatable by a user of the wheelchair by contact by the user with an outer surface of the portion of the flexible cover which is placed over the one or more actuating mechanisms.

14. The method of claim 13 wherein the flexible cover further comprises a releasable lower closure mechanism and the method further comprises securing the flexible cover around a bottom section of the control interface via the releasable lower closure mechanism.

15. The method of claim 13 wherein securing the flexible cover around the bottom section of the control interface comprises tightening a drawstring of the releasable lower closure mechanism.

16. The method of claim 13 further comprising closing a releasable rear closure mechanism of the flexible cover to secure the flexible cover around a rear section of the control interface.

* * * * *